US005765828A

United States Patent [19]

Baker et al.

[11] Patent Number: 5,765,828

[45] Date of Patent: Jun. 16, 1998

[54] POOL TABLE GOLF APPARATUS AND METHOD OF PLAY

[75] Inventors: Randy A. Baker, Selinsgrove; Stephen E. Peteraf, Winfield, both of Pa.

[73] Assignee: Skilliards, Inc., Winfield, Pa.

[21] Appl. No.: 816,509

[22] Filed: Mar. 13, 1997

[51] Int. Cl.[6] ..... A63B 67/00

[52] U.S. Cl. ..... 273/108.2; 273/108.21; 473/157; 473/18; 473/20; 473/31

[58] Field of Search ..... 273/108.2, 108.21, 273/108.5; 473/167, 157, 162, 8, 18, 20, 31

[56] References Cited

U.S. PATENT DOCUMENTS

| | | | |
|---|---|---|---|
| D. 84,068 | 5/1931 | Andrus | 273/108.2 X |
| 713,253 | 11/1902 | Taylor | 273/108.2 |
| 1,813,116 | 7/1931 | Clausen | 273/108.21 X |
| 3,360,265 | 12/1967 | Yabroudy | 273/108.21 |
| 3,578,321 | 5/1971 | Skully et al. . | |
| 3,591,176 | 7/1971 | Roth . | |
| 3,801,101 | 4/1974 | Greenberg | 273/108.21 |
| 3,871,650 | 3/1975 | Casey | 473/162 |
| 3,884,469 | 5/1975 | Morton | 273/108.21 |
| 4,004,804 | 1/1977 | Gholson . | |
| 4,114,876 | 9/1978 | Maruszak . | |
| 4,429,881 | 2/1984 | Barrett . | |
| 4,461,476 | 7/1984 | Tudek . | |
| 4,790,534 | 12/1988 | Jamison . | |
| 4,874,167 | 10/1989 | Hillard . | |
| 4,875,680 | 10/1989 | Gross . | |
| 4,957,288 | 9/1990 | Kantner et al. . | |
| 5,116,048 | 5/1992 | Bilocerkowycz et al. . | |

*Primary Examiner*—Raleigh W. Chiu
*Attorney, Agent, or Firm*—Paul & Paul

[57] ABSTRACT

A golf game, for one or more participants, played on a plurality of tables, a single golf hole played upon each table including providing of multi-sided, substantially non-symmetric playing tables, each table having a playing area to simulate a golf hole, each table having a playing surface with raised peripheral side edges with both resilient and non resilient bumpers surrounding the playing surface defining the overall boundary of the golf hole, a single ball receiving hole. The game further includes providing a playing ball for each participant and a cue stick for striking the playing ball within the boundary of each golf hole. In turn, each participant, using the cue stick, propels a ball from a tee-off area on the table to the ball receiving hole.

12 Claims, 5 Drawing Sheets

POOL TABLE GOLF APPARATUS AND METHOD OF PLAY

BACKGROUND OF THE INVENTION

This invention relates generally to the game of golf and the game of pool.

Indoor and outdoor golf courses have been provided in various forms and are well known in the art. Some inventions have combined a golf game provided on a standard, rectangular pool table in which a typical six holes are provided; one hole on each corner and one hole centrally located on the long sides of the table. Additionally, some prior inventions for pool table-type golf games have fixed or movable obstructions and other hazards to more closely resemble an actual golf course. Still others include a golf-type game played on a table. None of these games, however, combines the unique features of the present invention to yield a table top game very similar in play and strategy to a golf game played on grass on a natural golf course.

SUMMARY OF THE INVENTION

The present invention relates to an apparatus and method of playing a table top golf game. The present invention utilizes an entire simulated natural golf course on a smaller, multiple table scale, one table for each hole of the golf course. Specialized techniques of pool are required in combination with specialized strategy and play of golf such that, like natural golf, the play may be infinitely challenging and ever-changing.

The table top golf game of the present invention is for one or more participants, is played on a several tables, a single golf hole played upon each table. The apparatus includes multi-sided, substantially non-symmetric playing tables, each table having a playing area to simulate a golf hole. Each table further has a playing surface with raised peripheral side edges surrounding said playing surface defining the overall boundary of the golf hole and a single ball receiving means. The game further includes a playing ball for each participant and a cue stick for striking the playing ball within the boundary of each golf hole. In turn, each participant, using the cue stick propels a ball from a tee-off area on said table to the ball receiving means. The method of play utilizes the above apparatus whereby participants play a game of golf, like an actual gaming of golf, moving from one table or "hole" until a round of golf is played on up to eighteen tables.

It is therefore an object of the present invention to provide a new and improved table top golf game.

It is another object of the present invention to provide a game and apparatus for playing a game which combines the games of golf and pool on a table top course.

It is another object of the present invention to provide a new and improved table top golf game in which a multi-hole golf course is provided on a plurality of tables, each table having a single golf hole.

It is a further object of the present invention to provide a new and improved table top golf game in which a multi-hole golf course is provided on a plurality of tables, each table having a playing surface and a single golf hole and each table having raised edges which define the outer boundaries of the single hole.

It is a another object of the present invention to provide a new and improved table top golf game in which a multi-hole golf course is provided on a plurality of tables, each table having a playing surface and a single golf hole and each table having raised edges which define the outer boundaries of the single hole, at least some of the raised edges having resilient surfaces to provide bumpers for a playing ball.

It is another object of the present invention to provide a new and improved table top golf game in which a multi-hole golf course is provided on a plurality of tables, each table having a playing surface and a single golf hole and each table having raised edges which define the outer boundaries of the single hole, said outer boundaries of the single hole forming the outer boundaries of the table, wherein the periphery of the table is irregularly and non-symmetrically shaped to simulate an actual golf hole.

It is another object of the present invention to provide a new and improved table top golf game in which a multi-hole golf course is provided on a plurality of tables, each table having a playing surface and a single golf hole and each table having raised edges which define the outer boundaries of the single hole, where golf playing hazards are present on the playing surface of the table, including, but not limited to simulated trees, sand traps, water hazards, undulating, non-planar or angled surfaces, contours, roughs, greens, dog legs, and the like.

Other objects and advantages of the present invention will become apparent from the following description taken in conjunction with the accompanying drawings.

DESCRIPTION OF THE PREFERRED EMBODIMENT

Figure 1:
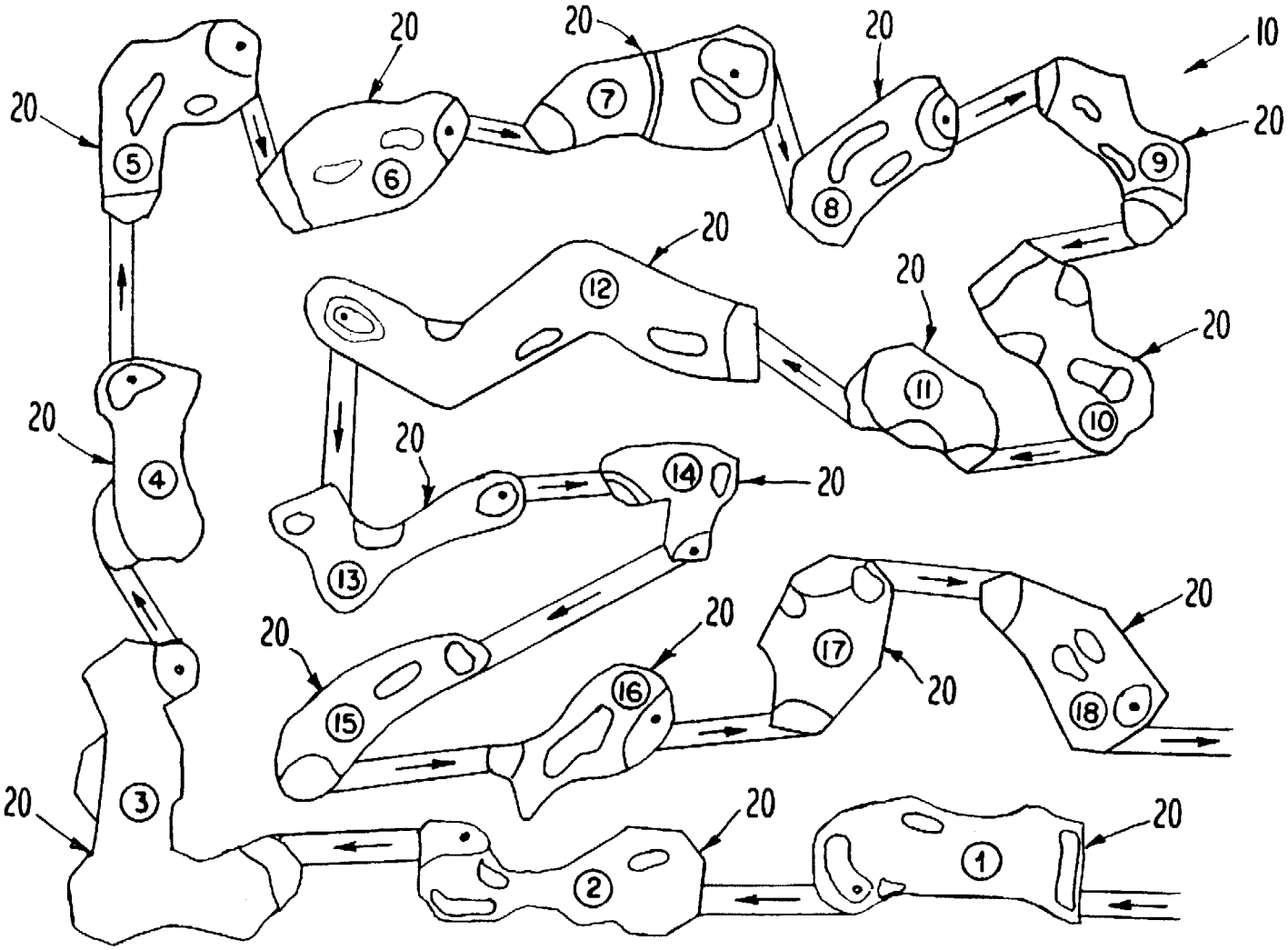
FIG. 1 is a top, plan, schematic view of a typical 18-hole table golf game in accordance with one preferred embodiment of the present invention.

Referring now in detail to the drawings, wherein like reference numerals indicate like elements throughout the several views, there is shown in FIG. 1 a typical pool table golf course layout 10 in accordance with one preferred embodiment of the present invention. As can be seen in FIG. 1, there is depicted a schematic example of an eighteen hole golf course, with eighteen tables 25, numbered consecutively 1–18, one table 25 for each golf hole 20. In this particular embodiment, the golf holes 20 are played serially by one or more players until a round of eighteen holes is played, like that of a natural golf course. For purposes of this invention, the term "hole" is used to define a golf course tee-off area, fairway, and green combination, while the phrase "ball receiving pocket" 24 is used to define the actual hole or cylindrical depression on the table 25 which is the ultimate destination of the balls 26 in play. The arrows depicted in FIG. 1 depict a typical 18-hole course route for the present invention. As in a natural golf course, the perimeter shape and other aspects of each of the eighteen holes 20 may be different. However, it is contemplated that smaller courses can be made of, for example, a nine hole course, having only nine tables, or, even only a single table for home use, that may be played one or more times to make a round of golf. Particularly for this last embodiment, the tee-off area 22, or even the ball receiving pocket 24 location itself, may be moved to change the "play" of the hole.

Figure 2:
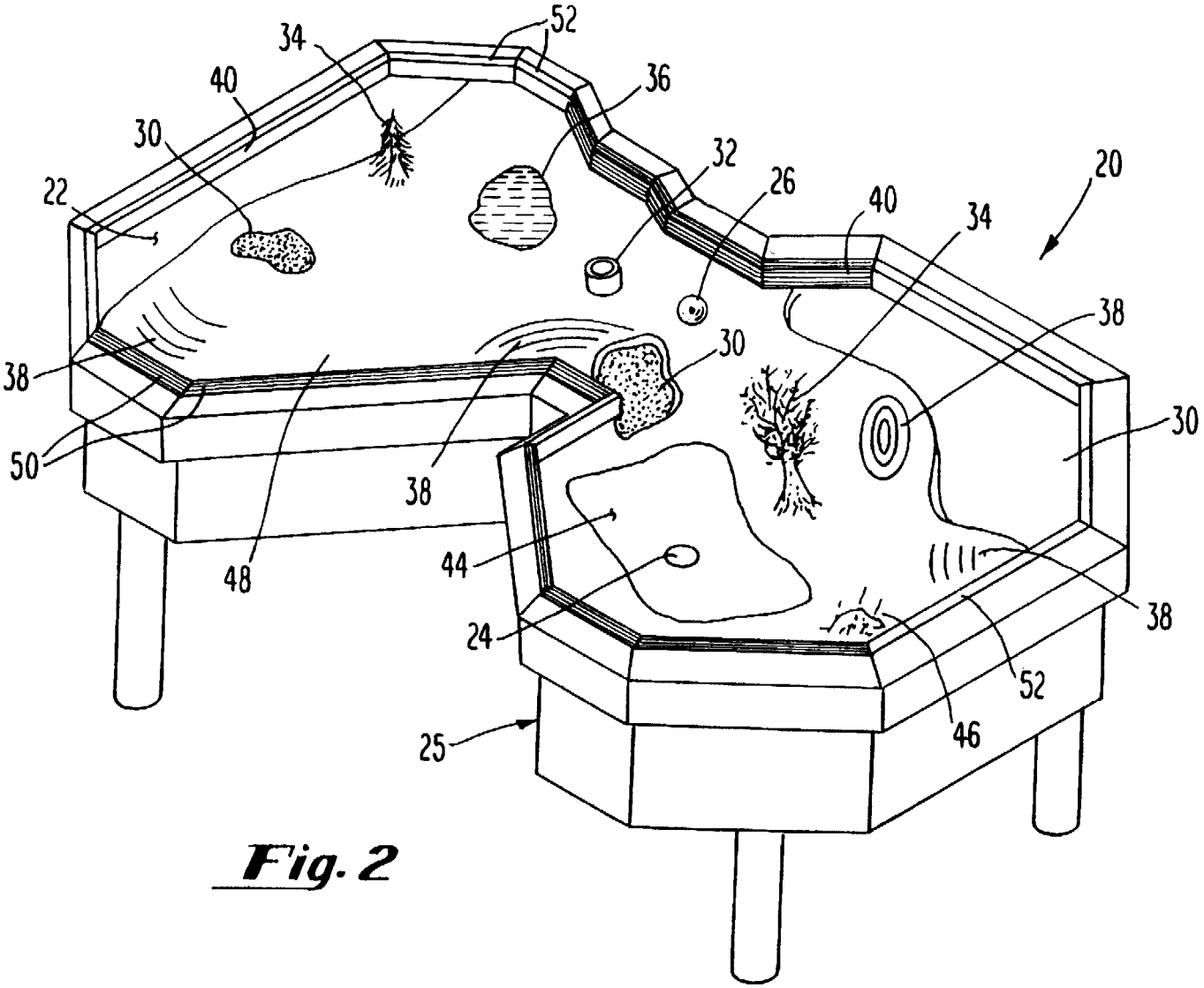
FIG. 2 is a perspective view of a typical single hole table of the golf game of FIG. 1.
Figure 3:
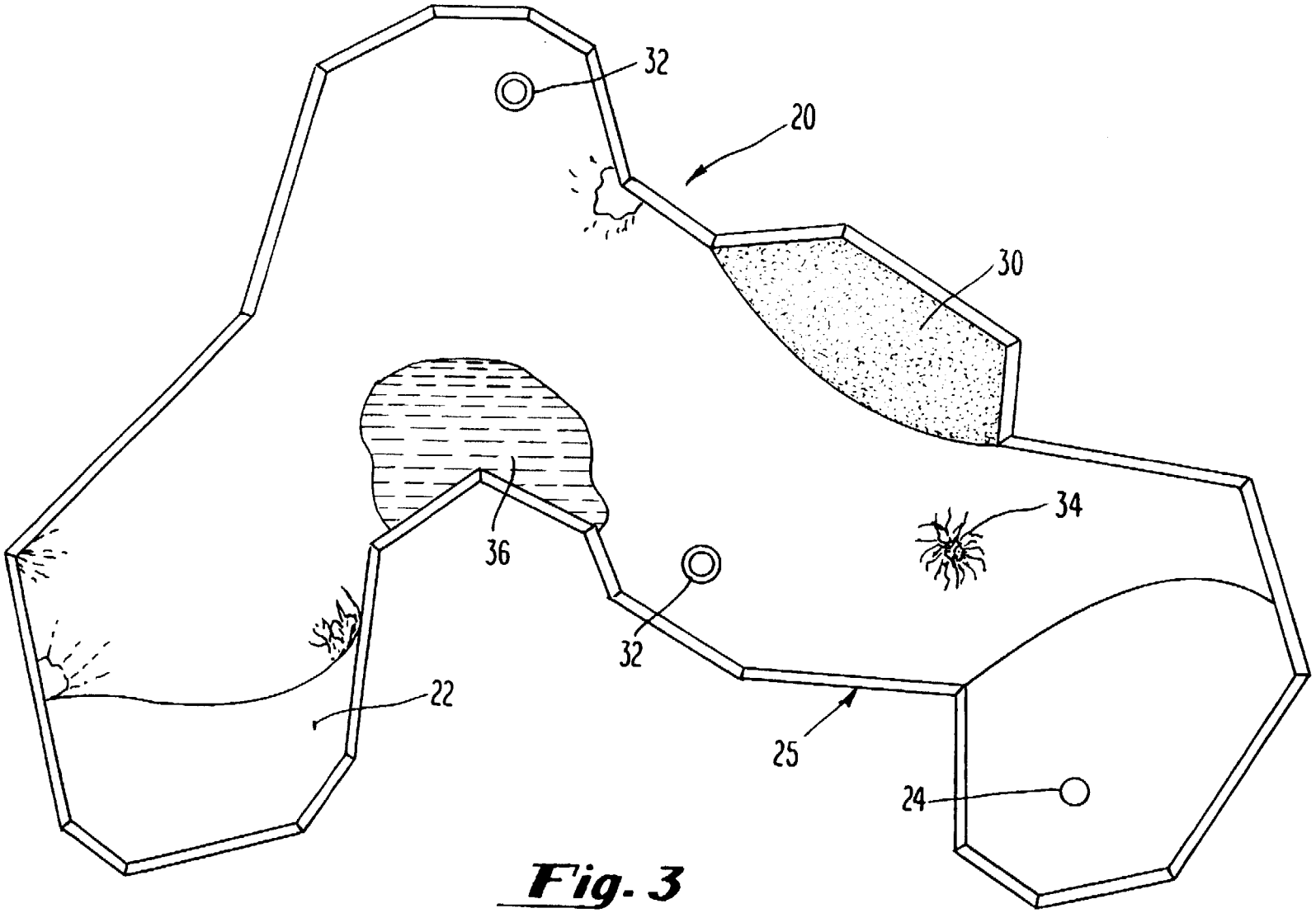
FIG. 3 is a top, plan view of another typical single hole table in accordance with the golf game of FIG. 1.

The perspective view of FIG. 2 and the top plan view of FIG. 3 depict examples of single holes 20, showing instances of many of the "hazards" and other elements that may be included in a single hole 20. In the primary embodiment contemplated, the tables 20 may range from, perhaps, six or eight feet long for short, "par 3" holes, up to, perhaps, thirty feet long for a difficult "par 5" hole. However, limitations as to size are only confined to that which can be comfortably played by an adult. It is contemplated a course approximately half the size indicated above may be made to fit in a smaller area.

As seen in FIGS. 1–3, the perimeter of substantially each table top hole 20 is constructed of a different, non-symmetric, undefined shape. Hazards, including sand traps or bunkers 30, rubber bumper pins 32 to simulate a golf ball deflecting off a tree in a fairway, simulated trees and bushes 34, water hazards 36, and/or undulating, non-planar, contoured table surfaces 38 (where the contour lines shown indicate varying elevation in the table top) may be utilized in the design of each hole 20.

Like a pool table, each table has raised edges 40 which define the outer boundaries or periphery of the single hole 20 of that table 25. The outer boundaries of the single hole form the outer boundaries of the table, wherein the periphery of the table is irregularly, non-symmetrically shaped to simulate an actual, natural golf hole.

The table top surface material or covering 46 is preferably standard pool table felt. However, indoor/outdoor carpeting, or any other similar material that can be used to simulate natural grass may be found to offer satisfactory play. Additionally, the table 25 and table top surface material 46 may be made from materials suitable for outdoor play, such that the course may be constructed in an outdoor setting. For example the table itself may be made from concrete, with proper drainage provided. This may be particularly advantageous due to the considerable space requirements a full size, eighteen hole course of this invention requires. Finally, it may be desirable to install padding, perhaps 1/16" thick (not shown), beneath the top surface material to add durability to the life span of the material, particularly if standard pool table felt is used.

A separate tee-off area 22 may be incorporated onto the table top covering 46 of table 20, using, perhaps, a different color or weight material, such as felt, carpeting, or other table top covering material 46, again to simulate a natural course. Alternatively, the tee-off area can be merely marked on the covering material 46. Likewise, optionally, the "green" area 44 may be of a different color and or weight material to decrease or otherwise change the rolling resistance of the ball 26 in that area. Finally, if desired, fairways (relatively smooth), roughs, and other different textured surfaces may be incorporated into the table top by both contours 38 and different material table top covering materials 46 to simulate a natural golf course.

The pool table surface 48, located under the covering material 46 is preferably constructed having an undulating "contoured" surface to simulate a natural golf course's grades, slopes, and valleys. Various contours 38 are depicted in FIG. 2 where the contour lines indicate changes in elevation of the table top.

Additionally other hazards may be built into the surface 48 such as recesses in the surface 48 that contains actual or simulated water and actual or simulated sand. It has been found that silicone gel or stone are appropriate substitutes for sand for purposes of the present invention. Additionally, simulated, naturally appearing trees and bushes 34, as well as rubber, pinball machine-style bumpers 32 may be installed on the table top surface 48 to add elements adding difficulty to the some or all of the tables 20.

Figure 4:
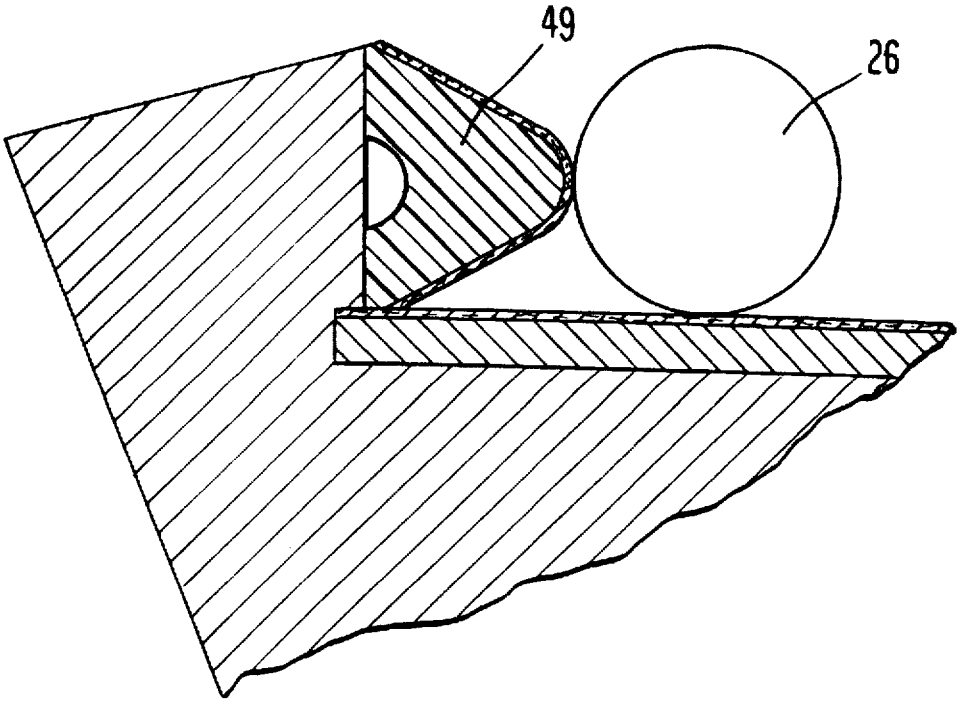
FIG. 4 is a side, cross sectional view of a prior art pool table bumper.
Figure 6:
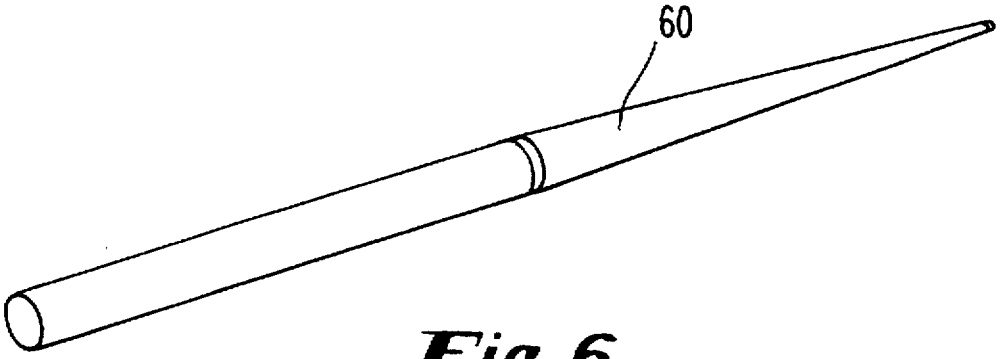
FIG. 6 is a perspective view of a cue stick for use in accordance with the invention of FIGS. 1–3.
Figure 5A:
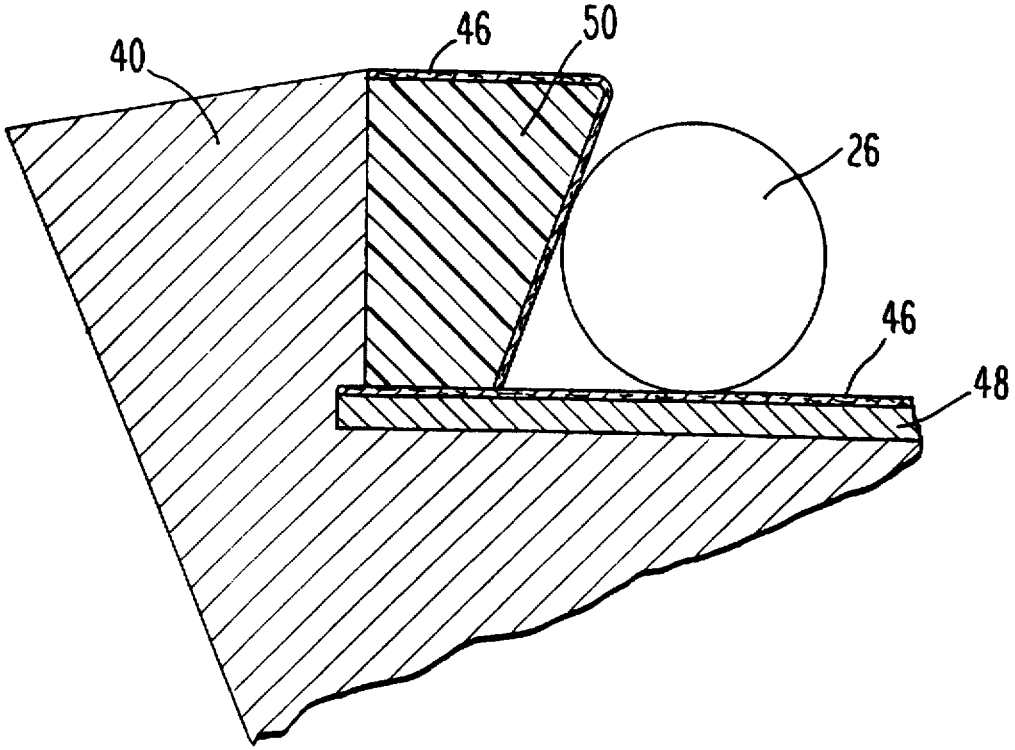
FIG. 5A is a side, cross-sectional view of a table in accordance with FIG. 1, depicting a pool table raised peripheral side edge having a pool table bumper in accordance with the present invention.

While it is contemplated that standard pool table bumpers or cushions 49, as depicted in FIG. 4 may be suitable for the present invention, it has been found to be preferable to use a specially designed bumper 50 to improve play and to keep the playing balls 26 on the table. See FIG. 5A. While a standard pool table cushion 49 is typically approximately symmetric and hits a pool ball 26 approximately in the center of the ball 26, the best cushion found for use with the present invention hits a pool ball 26 above its center point, thus keeping the ball 26 down on the table playing surface 48 as depicted in FIG. 5A.

Figure 5B:
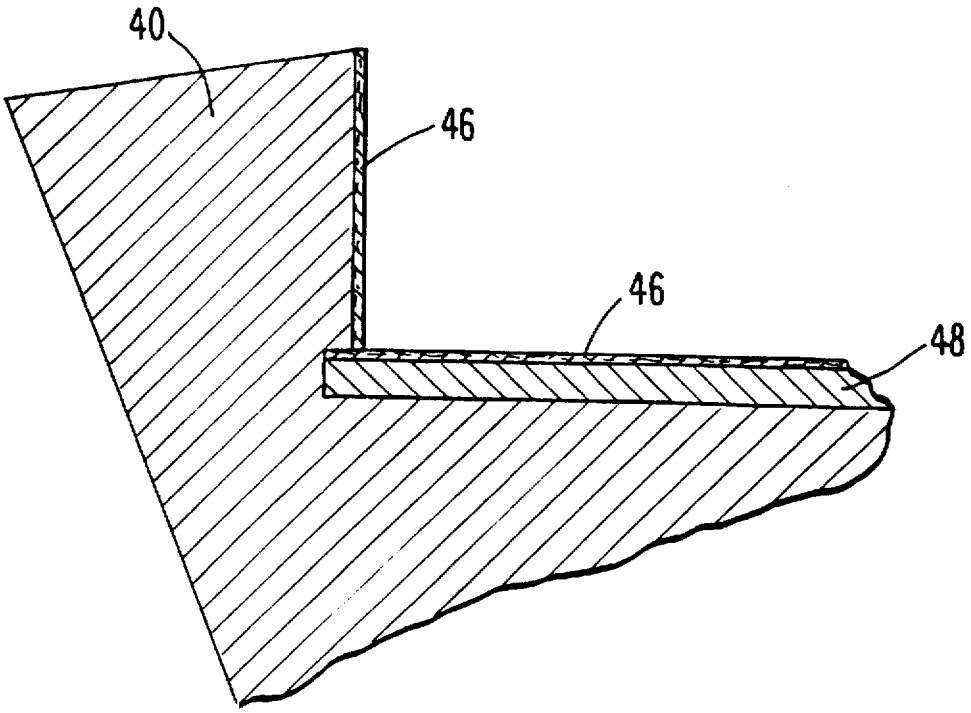
FIG. 5B is a side, cross-sectional view of a table in accordance with FIG. 1, depicting a pool table raised peripheral side edge without a pool table bumper in accordance with the present invention.

Additionally, unlike a standard pool table, the bumpers 50 are preferably not installed around the entire inner periphery of the pool table. As can be seen in FIGS. 2 and 3, bumpers 50, which are depicted shaded, are inter-mixed with areas without bumpers 52 (no shading), thereby making the play of the present game more unpredictable, as in natural golf. See FIG. 5B. In areas where no rubber bumpers 50 are installed, the pool table surface material 46 may be installed directly against a hard, non-resilient, side surface, for example wood, to slow down the ball. Additionally, if desired, a different bumpers may be made from a less "bouncy" materials such that the play can be made more unpredictable.

By utilizing optimally placed bumpers 50, bumper-less side walls 52, and hazards, a "hole-in-one" may be designed into some or all of the holes 20 in the course. This can be designed to be possible only where a ball is placed in the tee-off area 22 in a proper position and the ball 26 is struck by a pool cue with proper force and is deflected from an appropriate series of bumpers 50 and bumper-less side walls 52, at appropriate angles. As in a natural golf game, hazards can be built into the play of a hole such that where a person attempts to make a hole-in-one, but fails, the ball will end up in, perhaps, a sand trap 30 or water hazard 36.

In the preferred embodiment, it is also contemplated that the raised edges 40 and bumpers 50 are constructed of a series of straight sections, to improve somewhat the predictability of the play and to make construction of each table somewhat less complicated (see FIG. 2). However, some or all of the raised edges 40 on some or all of the tables 25 may also be curved to make bank shots more unpredictable (See FIG. 1).

The balls 26 used in the play of the game may be standard two and one-eighth inch pool table balls. Alternatively, a smaller, specially designed pool/golf ball, one and seven-eighths inches in diameter, may be used which combines the look of a smaller golf ball, with the heavier weight of a pool ball.

A pool table style ball return may be added to each table, if desired (not shown), where, when the ball drops into the ball receiving pocket 24, it is returned to an end of the table. Additionally an electronic counter to count plays through one or more holes is contemplated for record keeping purposes (not shown).

In play, each player or participant uses a cue stick 60 or other ball propelling means to move his ball 26 from the tee off area 22 to the or ball receiving pocket 24. The number of strokes per hole is counted, and a tally for an entire course of, for example, eighteen holes, may be kept for each player. Each player may complete a hole, or two or more players may compete against one another and each take one shot at a time, as in a genuine golf game.

It will be recognized by those skilled in the art that changes may be made in the above described embodiments of the invention without departing from the broad inventive concepts thereof. It is understood, therefore, that this invention is not limited to the particular embodiments disclosed, but is intended to cover all modifications which are within the scope and spirit of the invention as defined by the appended claims.

I claim:

1. A method of playing a golf game, for one or more participants, played on a plurality of tables, a single golf hole played upon each table comprising:

a) providing a plurality of multi-sided, substantially non-symmetric playing tables, each table having a playing area to simulate a golf hole, each said table comprising:

i) a playing surface with raised peripheral side edges surrounding said playing surface defining the overall boundary of the golf hole wherein at least some of said raised side edges comprise resilient bumpers and all remaining raised side edges comprise hard, non-resilient surfaces;

ii) a single ball receiving means;

b) providing a playing ball for each participant;

c) providing a ball propelling means for striking said playing ball within the boundary of each golf hole; and d) in turn, each participant, using said ball propelling means, propelling a ball from a tee-off area on said table to said ball receiving means.

2. The method of playing a golf game as described in claim 1, wherein said step of providing said playing surface includes providing a non-planar playing surface, formed with undulating surfaces and angled contours.

3. The method of playing a golf game as described in claim 1, wherein said step of providing a playing table comprises providing a playing surface having hazards.

4. The method of playing a golf game as described in claim 3, wherein the step of providing a playing table comprises a playing surface having hazards includes hazards including simulated trees, sand traps, water hazards, undulating or angled surfaces, contours, roughs, and greens.

5. The golf game as described in claim 1, wherein said step of providing a ball propelling means includes providing a cue stick.

6. A method of playing a golf game, for one or more participants, played on a plurality of tables, a single golf hole played upon each table comprising:

a) providing a plurality of multi-sided, substantially non-symmetric playing tables, each table having a playing area to simulate a golf hole, each said table comprising:

i) a playing surface with raised peripheral side edges surrounding said playing surface defining the overall boundary of the golf hole wherein at least some of said raised side edges comprise resilient bumpers and all remaining raised side edges comprise hard, non-resilient surfaces;

ii) a non-planar playing surface, formed with undulating surfaces and angled contours;

iii) said playing surface having hazards including simulated trees, sand traps, water hazards, undulating or angled surfaces, contours, roughs, and greens; and iv) a single ball receiving means;

b) providing a playing ball for each participant;

c) providing a cue stick for striking said playing ball within the boundary of each golf hole; and d) in turn, each participant, using said cue stick propels a ball from a tee-off area on said table to said ball receiving means.

7. A golf game apparatus, for one or more participants, comprising:

a) a plurality of multi-sided, substantially non-symmetric playing tables, each table having a playing area to simulate a golf hole, each said table comprising:

i) a playing surface with raised peripheral side edges surrounding said playing surface defining the overall boundary of the golf hole wherein at least some of said raised side edges comprise resilient bumpers and all remaining raised side edges comprise hard, non-resilient surfaces;

iv) a single ball receiving means;

b) a playing ball for each participant; and c) a ball propelling means for striking said playing ball within the boundary of each golf hole.

8. The golf game apparatus as described in claim 7, wherein said playing surface includes a non-planar playing surface, formed with undulating surfaces and angled contours.

9. The golf game apparatus as described in claim 7, wherein said playing table comprises a playing surface having hazards.

10. The golf game apparatus as described in claim 9, wherein said playing table comprises a playing surface having hazards comprising simulated trees, sand traps, water hazards, undulating or angled surfaces, contours, roughs, and greens.

11. The golf game apparatus as described in claim 7, wherein said ball propelling means is a cue stick.

12. A golf game apparatus, for one or more participants, comprising:

a) a plurality of multi-sided, substantially non-symmetric playing tables, each table having a playing area to simulate a golf hole, each said table comprising:

i) a playing surface with raised peripheral side edges surrounding said playing surface defining the overall boundary of the golf hole wherein at least some of said raised side edges comprise resilient bumpers and all remaining raised side edges comprise hard, non-resilient surfaces;

ii) a non-planar playing surface, formed with undulating surfaces and angled contours;

iii) said playing surface having hazards including simulated trees, sand traps, water hazards, undulating or angled surfaces, contours, roughs, greens, and dog leg;

iv) a single ball receiving means;

b) a playing ball for each participant; and c) a cue stick for striking said playing ball within the boundary of each golf hole.

* * * * *